US007540057B2

(12) United States Patent
Lin et al.

(10) Patent No.: US 7,540,057 B2
(45) Date of Patent: Jun. 2, 2009

(54) MOP ASSEMBLY HAVING THEREIN A ROTATABLE DEVICE TO ALLOW A MOP HEAD TO ROTATE RELATIVE TO STICK AND A POSITIONING DEVICE TO ALLOW THE STICK TO BE POSITIONED WHEN NOT IN USE

(75) Inventors: Tien-Shih Lin, Hualien Hsien (TW); Ming-Che Ting, Hualien Hsien (TW)

(73) Assignee: Dikai International Enterprises Ltd. (TW)

( * ) Notice: Subject to any disclaimer, the term of this patent is extended or adjusted under 35 U.S.C. 154(b) by 847 days.

(21) Appl. No.: 11/237,793

(22) Filed: Sep. 29, 2005

(65) Prior Publication Data

US 2007/0067935 A1 Mar. 29, 2007

(51) Int. Cl.
*A47L 13/20* (2006.01)

(52) U.S. Cl. ..... 15/229.6; 15/228; 15/144.1; 15/144.2

(58) Field of Classification Search ..... 15/144.1, 15/144.2, 228, 229.1–229.9, 244.2, 143.1, 15/229.13

See application file for complete search history.

(56) References Cited

U.S. PATENT DOCUMENTS

| | | | | |
|---|---|---|---|---|
| 1,708,052 | A * | 4/1929 | Channell | 403/70 |
| 1,809,968 | A * | 6/1931 | Gedge | 401/155 |
| 1,832,068 | A * | 11/1931 | Watkins | 15/229.13 |
| 5,655,250 | A * | 8/1997 | Warrell | 15/228 |
| 6,339,979 | B1 * | 1/2002 | Chiang | 81/177.2 |
| 6,543,082 | B2 * | 4/2003 | Dingert et al. | 15/147.1 |
| 2007/0067935 | A1 * | 3/2007 | Lin et al. | 15/229.6 |

* cited by examiner

*Primary Examiner*—Lee D Wilson
(74) *Attorney, Agent, or Firm*—Bacon & Thomas, PLLC

(57) ABSTRACT

A mop assembly includes a rotatable device to allow the mop head to rotate relative to the stick so that the user will no longer need to manually rotate the mop head to continue cleaning the floor using the clean side and a positioning device to allow the stick to be temporarily positioned when the mop assembly is not in use and to enable the mop head to pivot relative to the stick to mitigate the trouble of lowering the stick to clean an area under furniture.

2 Claims, 5 Drawing Sheets

MOP ASSEMBLY HAVING THEREIN A ROTATABLE DEVICE TO ALLOW A MOP HEAD TO ROTATE RELATIVE TO STICK AND A POSITIONING DEVICE TO ALLOW THE STICK TO BE POSITIONED WHEN NOT IN USE

BACKGROUND OF THE INVENTION

1. Field of the Invention

The present invention relates to a mop assembly, and more particularly to a mop assembly having therein a rotatable device to allow a mop head to rotate relative to a stick and a positioning device to allow the stick to be positioned when the mop assembly is not in use.

2. Description of the Related Art

A conventional mop assembly normally has a mop head and a stick extending from the mop head so that the user is able to hold the stick to mop the floor using a strip assembly extending from the mop head. However, as the stick is rigidly connected to the mop bead, when a user tries to mop areas under furniture, the user will have to lower the stick to be able to extend the mop head into the area under the furniture, which is quite troublesome. In addition, after one side of the mop becomes dirty, the user will have to manually rotate the mop head to use the unsoiled side to continue cleaning the floor. This type of cleaning process is not only tiresome, but also labor intensive.

To overcome the shortcomings, the present invention provides an improved mop assembly to mitigate the aforementioned problems.

SUMMARY OF THE INVENTION

The primary objective of the present invention is to provide an improved mop assembly so that the user can easily implement the mop assembly.

One aspect of the present invention is the mop assembly of the present invention has a rotatable device to allow the mop head to rotate relative to the stick so that the user will no longer need to manually rotate the mop head to continue cleaning the floor using the clean side.

Another aspect of the present invention is the mop assembly of the present invention has a positioning device to allow the stick to be temporarily positioned when the mop assembly is not in use and to enable the mop head to pivot relative to the stick to mitigate the trouble of lowering the stick to clean an area under furniture.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
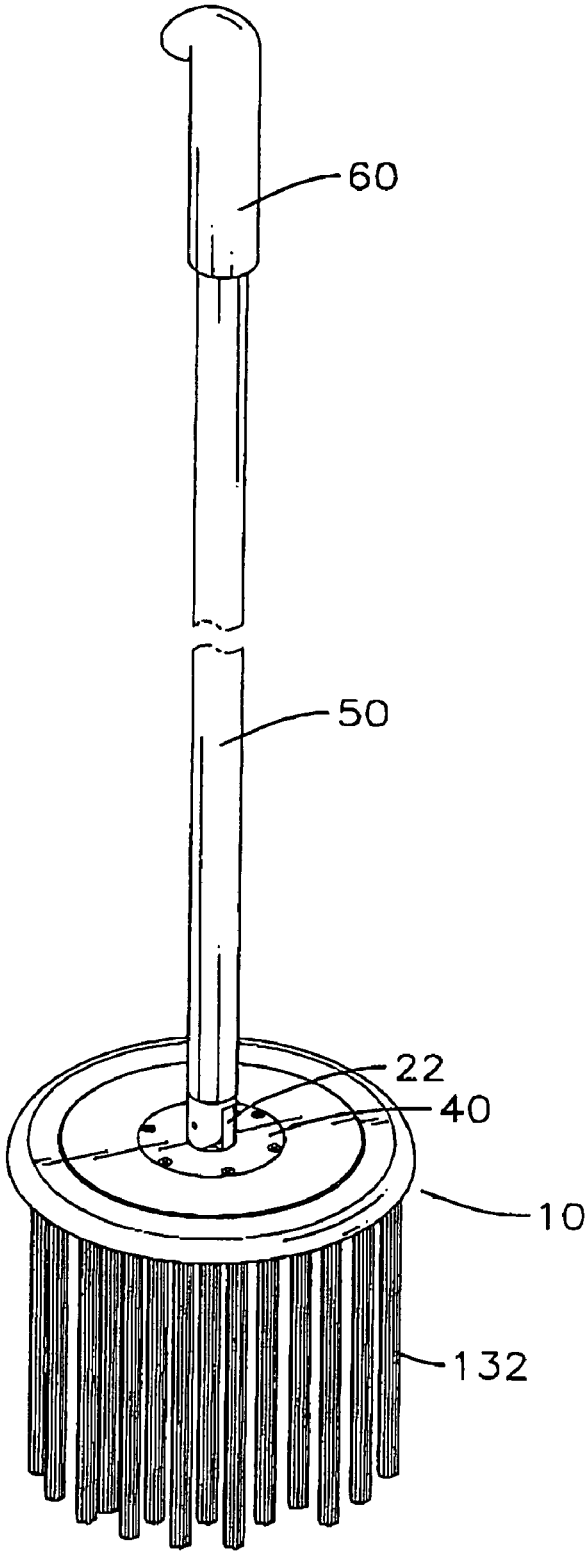
FIG. 1 is a perspective view of the mop assembly of the present invention.
Figure 2:
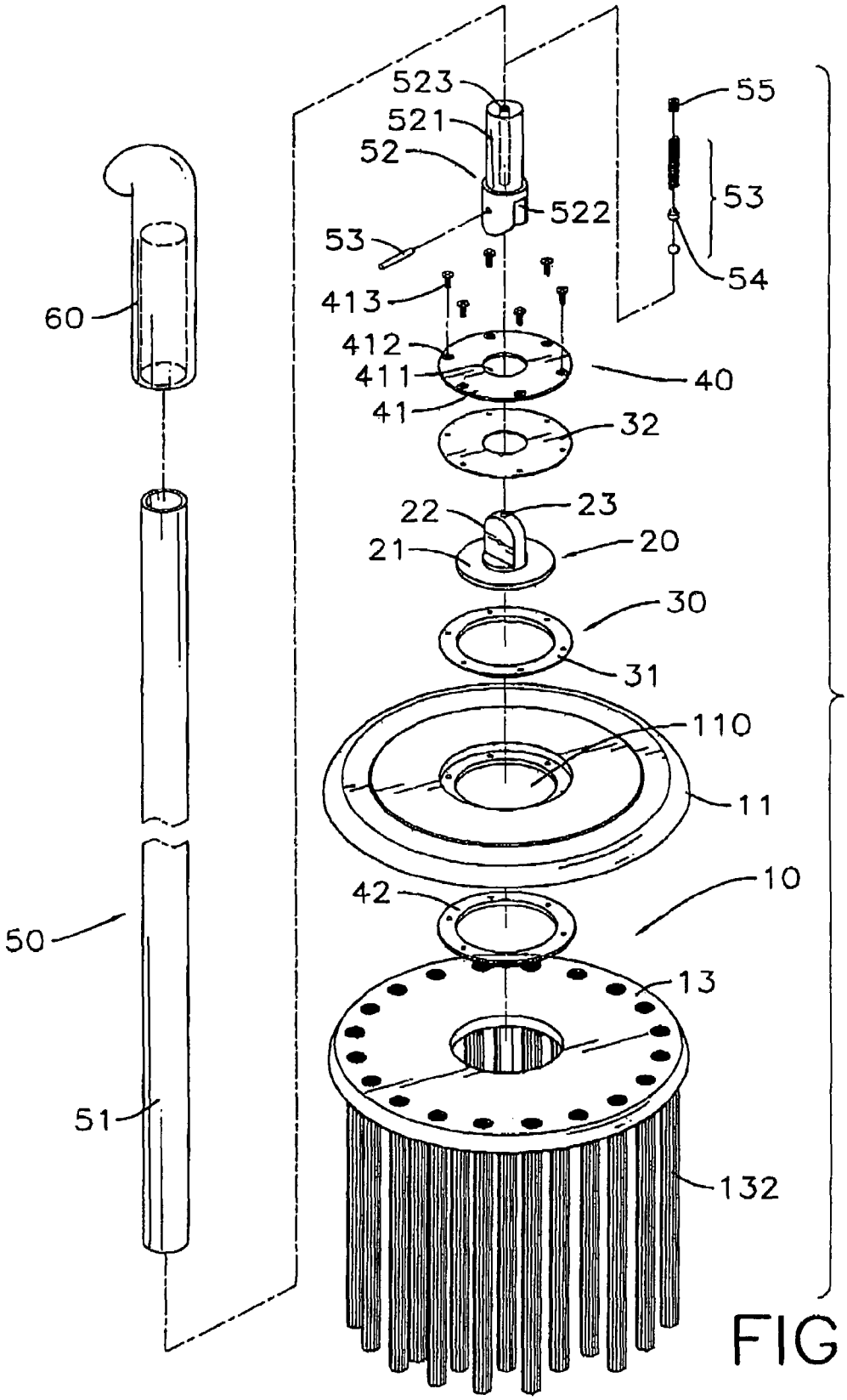
FIG. 2 is an exploded perspective view of the mop assembly to show relative positions among elements.

With reference to FIGS. 1 and 2, the mop assembly in accordance with the present invention includes a disk combination (10) with a covering disk (11) and an engaging disk (13), a pivoting head (20), a bearing assembly (30), a securing disk (40), a stick assembly (50) and a handle (60).

The covering disk (11) has a centrally defined recessed area (110) on a top face thereof and a receiving space (111) defined in a bottom face thereof. An outer periphery of the covering disk (11) is bent inward to form a securing hook (112). The engaging disk (13) having a first through hole (131) and multiple strips (132) made of cloth and extending downward from a bottom face of the engaging disk (13) is made of a resilient material so that the engaging disk (13) s able to be fitted into the receiving space (111) to allow an outer periphery of the engaging disk (13) to be securelysecured by the securing hook (112) so as to connect the covering disk (11) and the engaging disk (13).

The pivoting head (20) has a base (21) and a sectorial extension (22) extending upward from the base (21) and having a positioning recess (23) defined in an outer periphery of the sectorial extension (22).

The securing disk (40) includes a first disk (41) provided on top of the base (21) and a second disk (42) provided under the covering disk (11). The fist disk (41) has a first hole (411) centrally defined through a face of the first disk (41) and multiple securing holes (412) evenly distributed around an outer periphery of the first disk (41) to correspond to multiple securing elements (413). The second disk (42) also has multiple securing holes (not numbered) to correspond to the securing holes (412) of the first disk and the securing elements (413). Before combining the first disk (41) and the second disk (42), the pivoting head (20) is first placed on top of the recessed area (110) of the covering disk (11). Then the securing elements (413) are employed to secure engagement between the first disk (41) and the second disk (42) with the sectorial extension (21) extending out of the first hole (411) of the first disk (41) and the base (21) sandwiched between the first disk (41) and a bottom face defining the recessed area (11) of the covering disk (11). The pivoting head (20) is able to freely rotate relative to the covering disk (11) and the securing disk (40).

Preferably, a bearing assembly (30) is provided between the first disk (41) and the pivoting head (20) and includes an annular pad (31) placed on the face defining the 5 recessed area (110) and a pressing pad (32) together with the annular pad (31) to sandwich the base (21) of the pivoting head (20). Both the annular pad (31) and the pressing pad (32) have holes (not numbered) defined therethrough to correspond to the securing holes (412) of the first disk (41) and of the second disk (42) such that the securing elements (413) can be extended through the first disk (41), the pressing pad (32), the annular pad (31), the bottom face defining the recessed area (110) and the second disk (42) to secure the base (21) between the annular pad (31) and the pressing pad (32).

The stick assembly (50) comprises a stick (51) and a substantially Y-shaped connector (52). The stick (51) has an opening defined in a lower end thereof to receive therein a proximal end of the connector (52). The connector (52) has two open ends communicating with each other, a neck (521) having a diameter slightly smaller than an inner diameter of the lower open end of the stick (51) so that the neck (521) can be tightly inserted into the lower open end of the stick (51). A cutout (522) is defined in a distal end of the connector (52) to correspond to and receive therein the sectorial extension (22)

of the pivoting head (20) and a channel (523) defined in a proximal end of the connector (52) to communicate with the cutout (522) thereof. A ball-spring combination (53) is received in the channel (523) with a proximal end of the spring abutting a periphery defining the channel (523) and a distal end of the spring abutting the ball such that the ball is movable inside the channel (523) when the spring is compressed. Preferably, a ball seat (54) is provided between the distal end of the spring and the ball and has a concave face formed on a distal end thereof to receive a portion of the ball. A stop (55) also received in the channel (523) is provided to abut the proximal end of the spring. A pin (53) is extended through an outer periphery of a distal end of the connector and the sectorial extension (22), which is received in the cutout (522) of the connector (52), to allow the connector (52) to pivot relative to the pivoting head (20).

Figure 3:
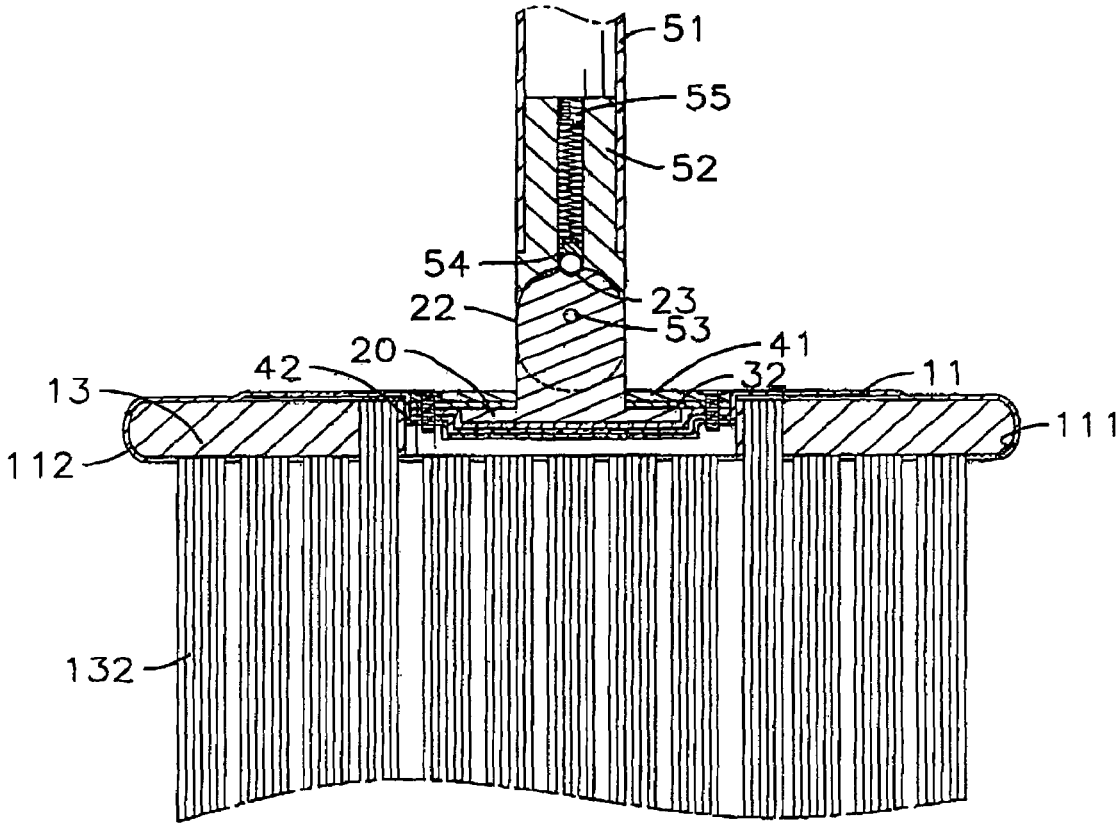
FIG. 3 is a cross sectional view showing the internal structure of the mop assembly after assembly.
Figure 4:
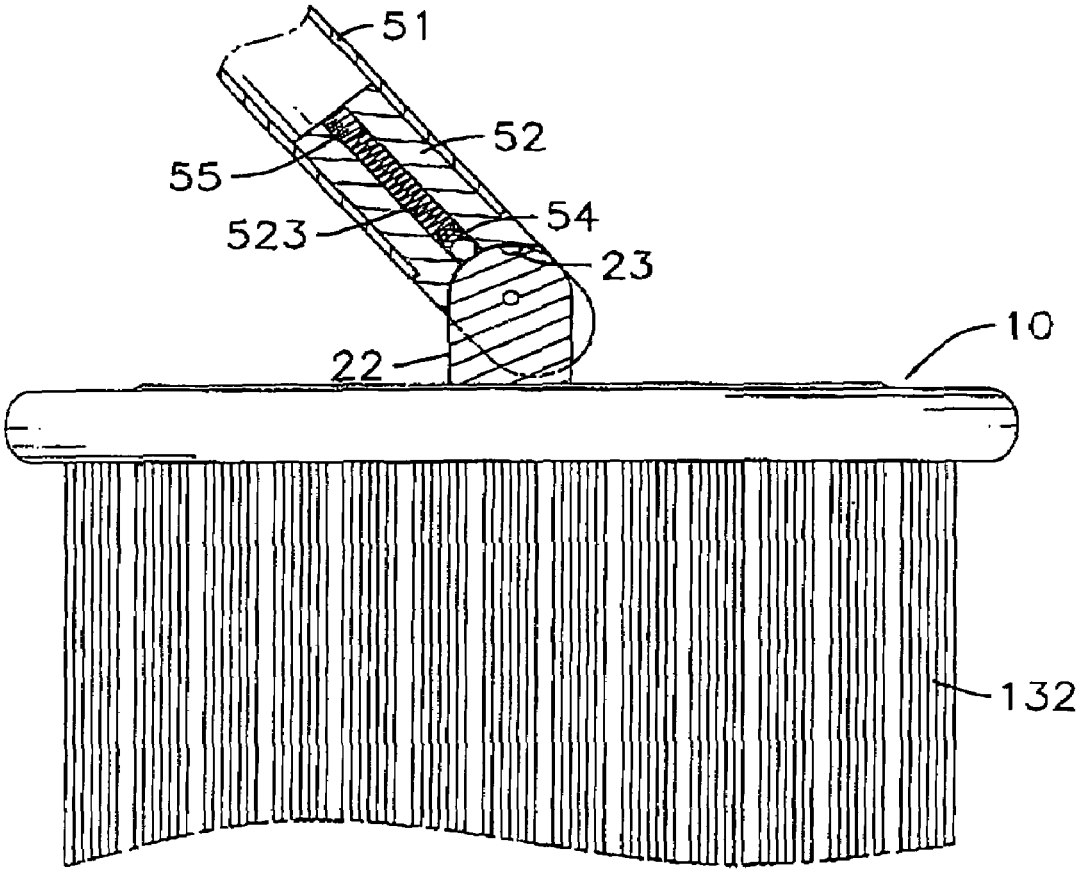
FIG. 4 is a schematic cross sectional view showing the mop assembly in application.

Furthermore, with reference to FIGS. 3 and 4, it is noted that after the stop (55), the ball-spring combination (53) and the ball seat (54) are received in the channel (523), the ball of the ball-spring combination (53) is extended into the positioning recess (23) so that the stick (51) with the connector (52) tightly inserted into the lower open end of the stick (51) is temporarily positioned. However, when the stick (51) is used and a force is applied to the stick (51), the ball will be forced into the channel (523) and slide on an outer periphery of the sectorial extension (22) when the stick (51) is pivoted relative to the pivoting head (20). The handle (60) is formed with a shape different from that of a circular shape such that the user can easily control movement of the mop assembly of the present invention.

From the above description, it is noted that because the disk combination (10) is able to freely rotate relative to the pivoting head (20), different sides of the strips (132) can be used during the application of the mop assembly of the present invention and situations where one side of the strips (132) is dirtier than the other side will no longer occur. Moreover, with the pivotal movement of the connector (52) relative to the pivoting head (20), the user will no longer be required to bend down to mop an area under an object.

Figure 5:
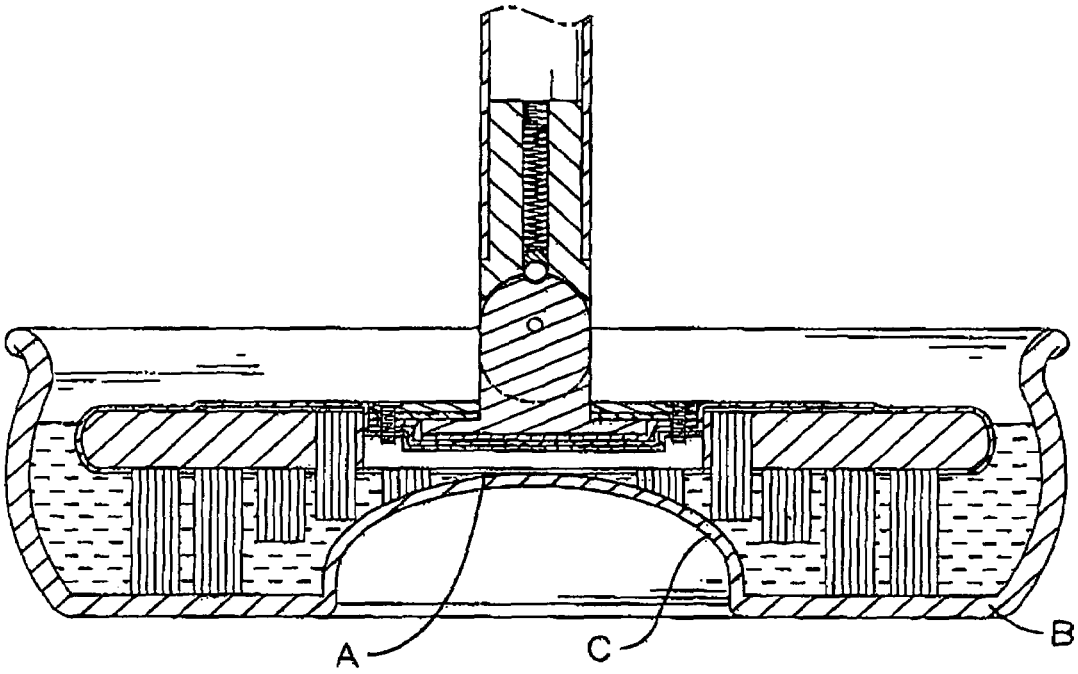
FIG. 5 is a schematic view showing that the mop assembly of the present invention is immersed in a basin for rinsing.

Furthermore, the strips (132) are vertically extending downward from the engaging disk (13). From the depiction of FIG. 2, it is noted that the strips (132) are arranged under the engaging disk (132) in such a way that a collecting area (A) is formed under the engaging disk (13) and in the center of the strips (132). With the provision of the collecting area (A), the user is able to use the mop assembly of the present invention to collect small garbage in the floor while mopping without hindering the manipulating the mop assembly. Furthermore, with reference to FIG. 5, it is noted that a basin (B) with a protruded area (C) is provided for rinsing the strips (132). After 8 the mop assembly of the present invention is immersed in the basin (B), the protruded area (C) corresponds to the collecting area (A) so that water in the basin (B) will not be spilled out of the basin (B). still, it is noted from the depiction of FIG. 5 that the strips (132) adjacent to the collecting area (A) have a length shorter than that of strips (132) away from the collecting area (A).

It is to be understood, however, that even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A mop assembly comprising:

a stick with an opening defined in a lower end thereof to securely receive therein a substantially Y-shaped connector having therein a neck to be inserted into the opening of the stick, a cutout defined in a distal end of the connector and a channel defined through the connector to communicate with the cutout and to receive therein a stop abutted to a bottom periphery defining the channel, a ball seat with an arcuate face, a spring sandwiched between the stop and the ball seat and a ball received in the arcuate face of the ball seat;

a pivoting head having a base and a sectorial extension extending upward from the base to be securely received in the cutout of the connector via a pin which extends through an outer periphery of the cutout and the sectorial extension and having a positioning recess defined in a periphery of the sectorial extension to receive therein the ball;

a disk combination having a covering disk provided with a recessed area defined in a top face of the covering disk to receive therein the base of the pivoting head and a receiving space defined in a bottom face of the covering disk and an engaging disk securely engaged with the covering disk and having multiple cleaning elements extending from a bottom face of the engaging disk;

a securing disk having a first disk on top of the base of the connector to securely sandwich the base of the pivoting head with the covering disk and a second disk securely attached to the bottom face of the covering disk and connected to the first disk via securing elements such that the base of the pivoting head is able to freely rotate relative to the disk combination; and a bearing assembly having a annular pad provided between the bottom face defining the recessed area of the covering disk and the base of the pivoting head and a pressing pad sandwiched between the base of the pivoting head and the first disk so as to prevent direct friction between the base of the pivoting head and the covering disk such that the connector is able to pivot relative to the pivoting head and the disk combination is able to freely rotate relative to the pivoting head.

2. The mop assembly as claimed in claim 1, wherein the cleaning elements are strips made of cloth.

* * * * *